US005946842A

United States Patent [19]

Nyzell et al.

[11] Patent Number: 5,946,842

[45] Date of Patent: Sep. 7, 1999

[54] FOLDING GRIP

[75] Inventors: Jan-Erik Nyzell; Ingvar Turesson, both of Eskilstuna, Sweden

[73] Assignee: BOFORS AB, Karlskoga, Sweden

[21] Appl. No.: 09/091,888

[22] PCT Filed: Jan. 15, 1997

[86] PCT No.: PCT/SE97/00029

§ 371 Date: Sep. 15, 1998

§ 102(e) Date: Sep. 15, 1998

[87] PCT Pub. No.: WO97/26500

PCT Pub. Date: Jul. 24, 1997

[30] Foreign Application Priority Data

Jan. 17, 1996 [SE] Sweden ..... 9600151

[51] Int. Cl.[6] ..... F41C 23/00; B64D 1/04

[52] U.S. Cl. ..... 42/72; 42/73; 89/1.42

[58] Field of Search ..... 42/72, 73, 71.01, 42/71.02; 89/1.42

[56] References Cited

U.S. PATENT DOCUMENTS

| | | | |
|---|---|---|---|
| 2,547,180 | 4/1951 | Taylor | 42/72 |
| 2,826,848 | 3/1958 | Davies | 42/71.01 |
| 4,271,623 | 6/1981 | Beretta | 42/72 |
| 4,321,765 | 3/1982 | Gillium | 42/72 |
| 4,660,311 | 4/1987 | Breitfeld et al. | 42/72 |
| 4,735,008 | 4/1988 | Williams | 42/71.02 |
| 5,417,002 | 5/1995 | Guerra | 42/72 |

FOREIGN PATENT DOCUMENTS

0484891 A2 5/1992 European Pat. Off. .

*Primary Examiner*—Charles T. Jordan
*Assistant Examiner*—Jeffrey Howell
*Attorney, Agent, or Firm*—Pollock, Vande Sande & Amernick

[57] ABSTRACT

The invention relates to a foldable grip for mounting on an elongate object, such as the barrel of a portable weapon. The grip comprises an elongate grip section and a hinge which connects the grip section to the elongate object. For effecting the movement between a folded-in position and a folded-out position, the hinge consists of an oblique pin to be affixed on the elongate object and of an oblique hole formed in the grip section and cooperating with the pin. During the movement of the grip section between the folded-in position and the folded-out position, the grip section turns through essentially 90 degrees around an axis in the longitudinal direction of the grip section.

10 Claims, 3 Drawing Sheets

FOLDING GRIP

FIELD OF THE INVENTION

The present invention relates to a foldable grip for mounting on an elongate object, such as the barrel of a portable weapon, and comprising an elongate grip section and a hinge for connecting the grip section to the elongate object. The grip in the folded-in position has a longitudinal direction which extends essentially parallel to the longitudinal direction of the object and in the folded-out position has a longitudinal direction which extends essentially at right angles out from the longitudinal direction of the elongate object.

BACKGROUND OF THE INVENTION

On portable weapons, for example, there is a need for grips which can be folded out in order to give the marksman better control over the weapon when firing. In this context, grips should not be mounted so that they are folded out permanently, since this makes it difficult to transport the weapon and increases the risks of the weapon being damaged or the marksman being injured during transportation. A known weapon design presently on the market has a foldable grip with a hinge which is in accordance with conventional hinge principles. For certain applications, however, this type of grip is clumsy and imprecise.

SUMMARY OF THE INVENTION

The object of the present invention is to make available a foldable grip which does not have the disadvantages mentioned above, is easy to maneuver between the folded-in position and the folded-out position,-and has precise positions both when folded out and folded in.

The object of the invention is achieved by means of a grip characterized in that the hinge comprises an oblique pin to be affixed on the elongate object and an oblique hole which is formed in the grip section and cooperates with the pin to effect an essentially 90 degree turn of the grip section around an axis in the longitudinal direction of the grip section during the movement of the grip between the folded-in position and the folded-out position. The oblique pin in combination with the oblique hole constitutes a hinge which can be made compact, and at the same time a well-defined movement process is obtained.

According to one advantageous embodiment, the pin and the hole are provided with locking shoulders for locking the grip in the folded-in and/or folded-out position. The locking shoulders give the hinge a well-defined folded-in position and folded-out position.

According to another advantageous embodiment, a spring element is arranged to act between the pin and the grip section. The choice of spring pretensioning defines the force which is needed for switching the grip section between the folded-in position and the folded-out position. The spring element is advantageously a helical spring.

To make the movement between the folded-in position and the folded-out position smooth, the pin and the grip section in yet another advantageous embodiment comprise sliding surfaces which face each other and cooperate directly.

According to an easy-to-grip and compact design, the grip section has an elongate shape transverse to the longitudinal direction of the grip section, which elongate shape relates to the hinge in such a way that the grip section in the folded-out position has a greater extent parallel to the longitudinal direction of the elongate object on which the grip is mounted than it has transverse to the longitudinal direction of the object. The elongate shape gives the handler a steady and comfortable grip when the grip is folded out and has the greater extent parallel to the longitudinal direction of the object. In the folded-in position, the grip lies with the lesser extent radially out from the longitudinal direction of the object. The grip extends out less from the elongate object and is therefore better protected during transportation and storage.

The invention will be described in greater detail hereinbelow on the basis of an example and with reference to the attached drawings, in which:

DETAILED DESCRIPTION OF THE PREFERRED EMBODIMENTS

Figure 1:
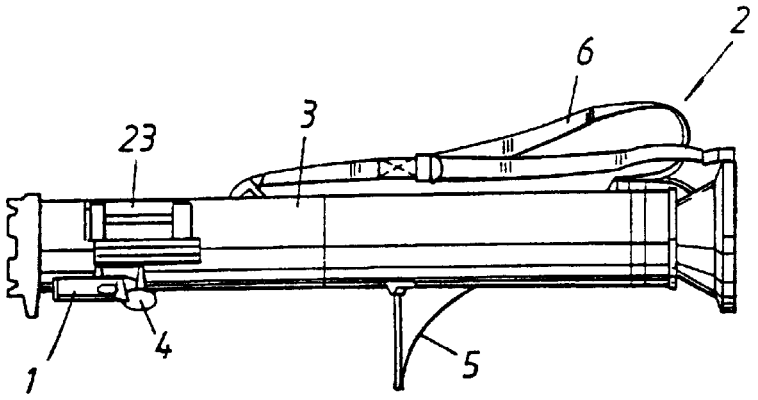
FIG. 1 shows a foldable grip according to the invention in the folded-in position mounted on a weapon.
Figure 2:
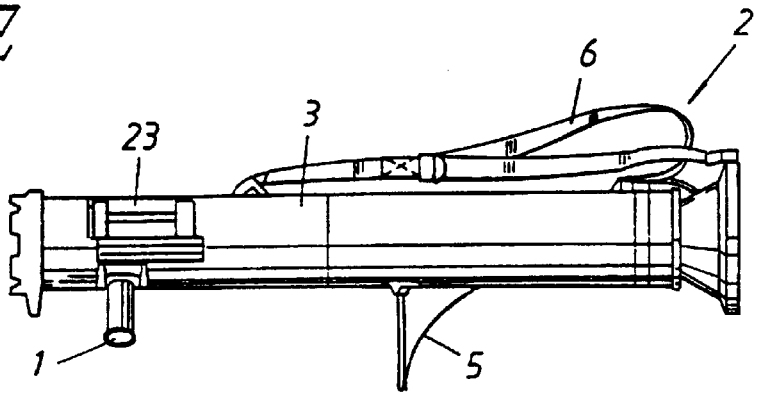
FIG. 2 shows the grip according to FIG. 1 in the folded-out position.

According to FIGS. 1 and 2, a foldable grip 1 is mounted on a portable weapon 2. The grip is in this case mounted in the front part of the weapon and functions as a front grip designed to be gripped in the marksman's left hand. The weapon shown comprises, among other things, a barrel 3 with a firing mechanism 4, a shoulder support 5, a harness 6 and a sight 23. To move the grip to the folded-out position shown in FIG. 2, the grip is pulled backwards and out from the barrel. When the grip is to be moved from the folded-out position to the folded-in position, it is pressed forwards and out from the barrel.

Figure 3:
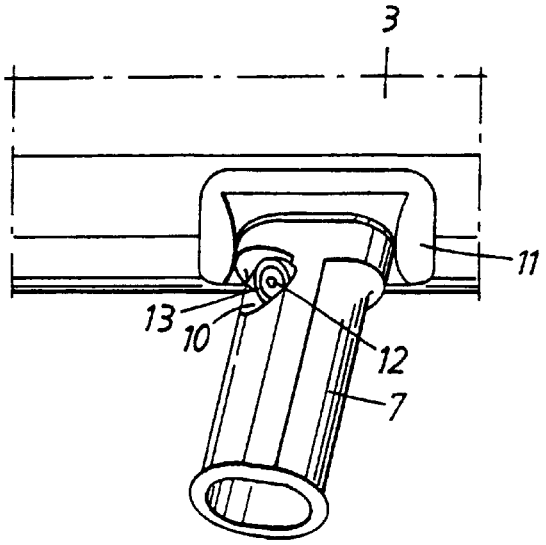
FIG. 3 shows the grip in greater detail in the folded-out position.
Figure 4A:
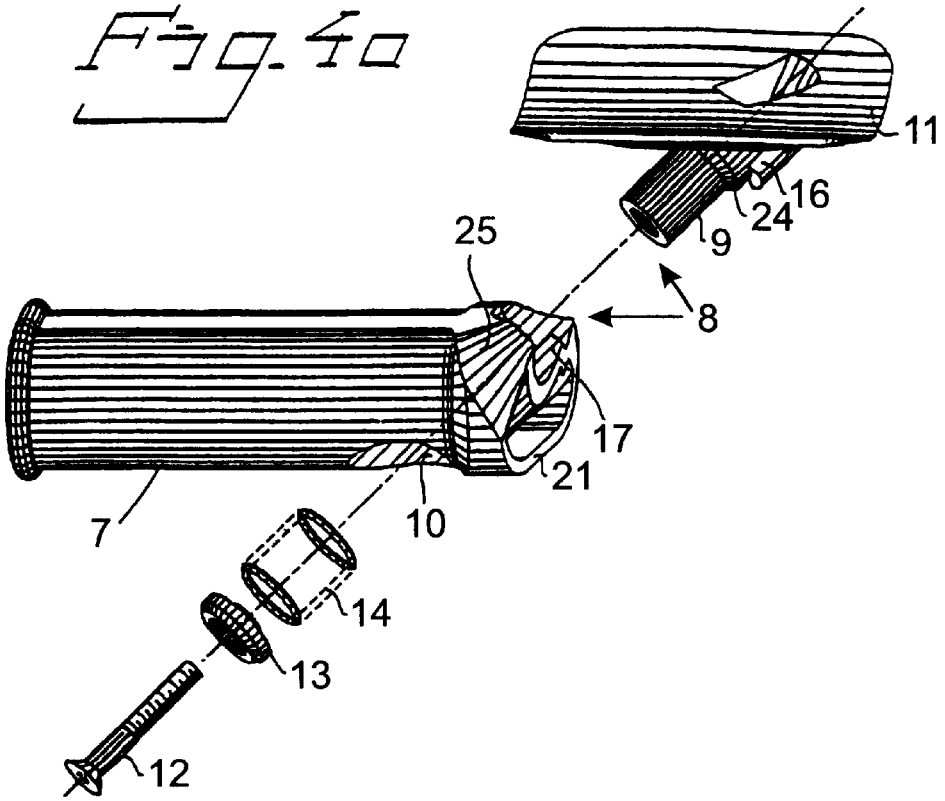
FIGS. 4*a* and 4*b* show the grip in the folded-in position in two exploded views essentially in opposite directions.
Figure 4B:
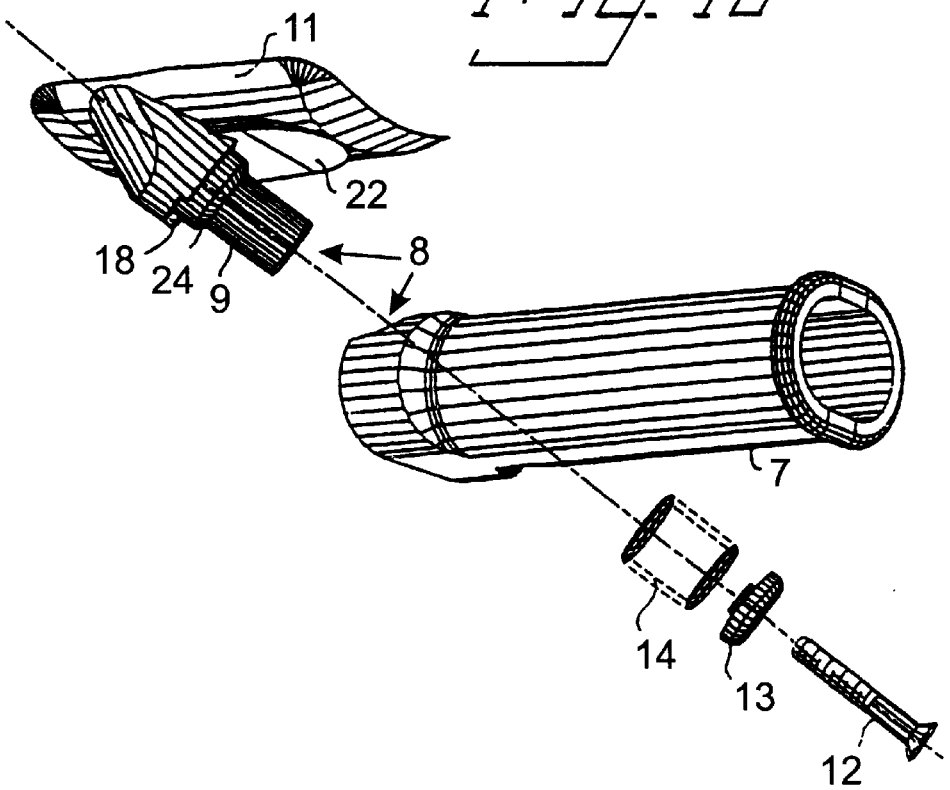
Figure 5A:
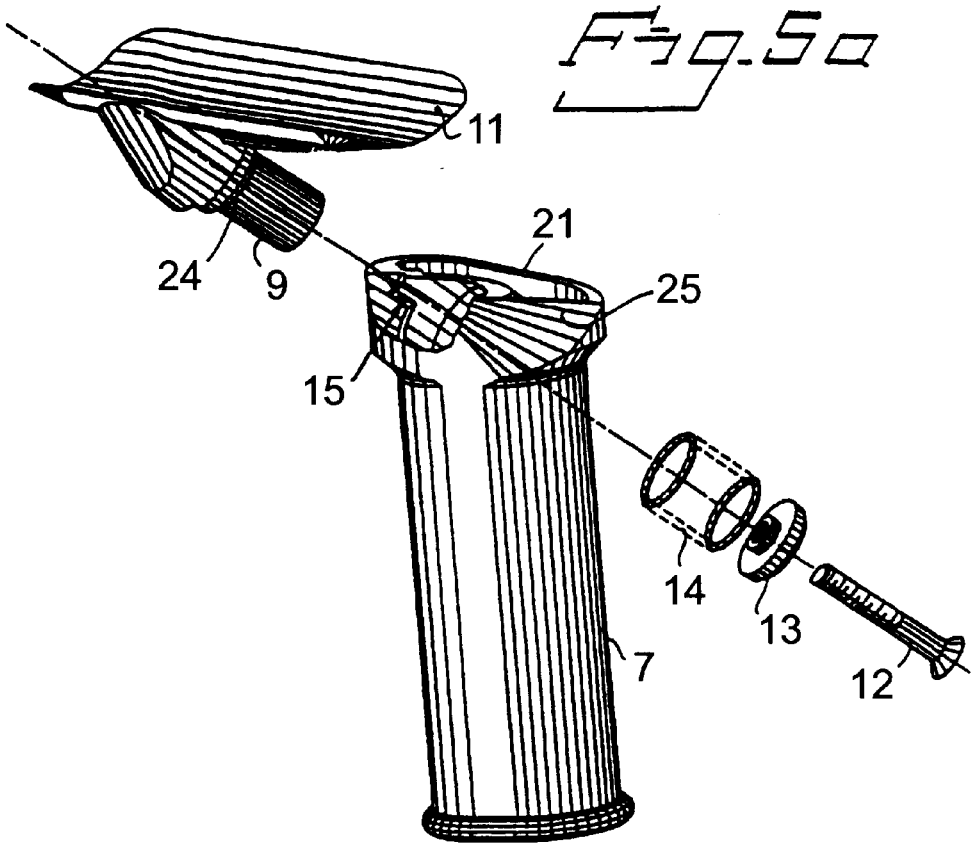
FIGS. 5*a* and 5*b* show the grip in the folded-out position in two exploded views essentially in opposite directions.
Figure 5B:
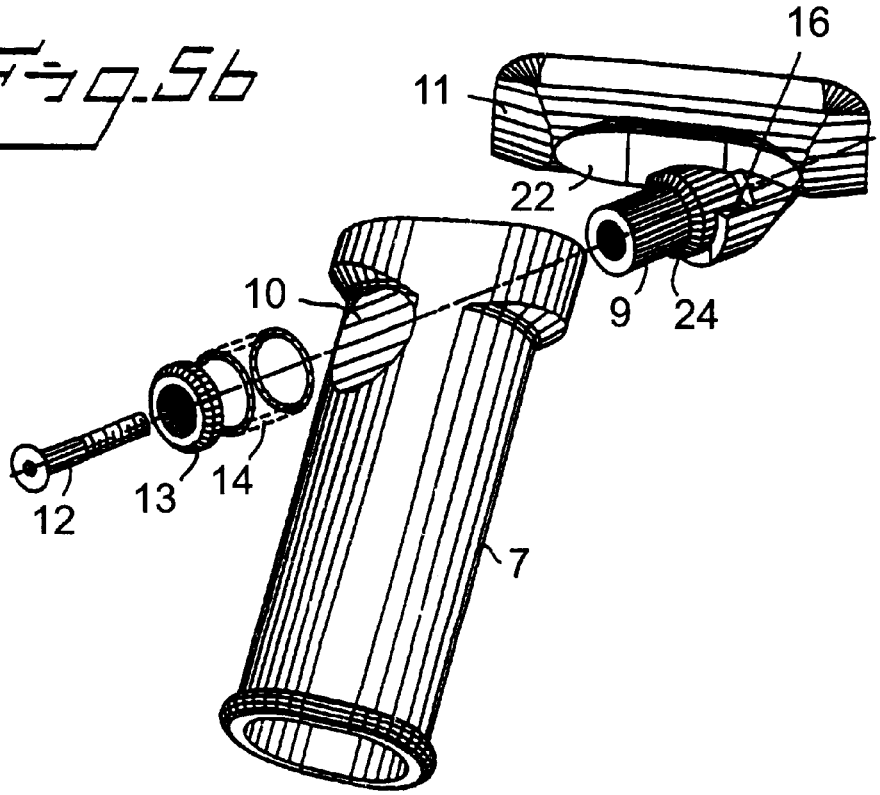

The more detailed construction and function of the grip is now described more closely with reference to the exploded views in FIGS. 4*a*, 4*b*, 5*a* and 5*b*, and also FIG. 3 which shows a folded-out grip in accordance with FIGS. 5*a* and 5*b* in the mounted state.

As is evident from the figures, the grip comprises a grip section 7 with a hinge 8. The hinge consists of a pin 9 and a hole 10 formed in the grip section 7. The pin 9 is made in one piece with a curved plate 11 intended to be applied to the barrel 3 of the weapon 2. The pin 9 is oblique relative to the curved plate 11 and leaves the plate in a direction obliquely forwards at an angle of about 45° and preferably between 30° and 45°. A transition area formed in the pin by increased dimensioning is designated by 24. The hole 10 is set obliquely relative to the longitudinal direction of the grip section and preferably forms an angle of about 45° relative to the longitudinal direction of the grip. The grip section 7 is held together with the pin 9 by means of a screw 12 which with the aid of a washer 13 tensions a helical spring 14 between the washer 13 and a dimensional reduction (not shown) in the inside of the hole 10.

In order to lock the grip in the folded-out position, the grip section 7 comprises a first locking shoulder 15 intended to cooperate with a corresponding first locking shoulder 16 formed on the pin 9. The locking shoulders 15, 16 prevent the grip section 7 from returning towards the folded-in position, and at the same time the end surface 21 of the grip section 7, cooperating with a sliding surface 22 in the curved plate 11, prevents continued movement beyond the intended folded-out position. The grip section correspondingly comprises a second locking shoulder 17 intended to cooperate with a corresponding second locking shoulder 18 formed on the pin in order to keep the grip in the folded-in position. At the same time, continued movement beyond the folded-in position is prevented because the grip section 7 is stopped against the barrel 3 of the weapon.

In order to facilitate the movement of the grip section between the folded-in position and the folded-out position, the grip section 7 is provided with a curved sliding surface 25 adapted for cooperation with the sliding surface 22 formed on the pin 9.

The grip section 7 is designed with an elongate shape transverse to the longitudinal direction of the grip section. In the folded-in position, the elongate shape has its minimum extent radially outwards from the jacket surface of the barrel, whereas in the folded-out position the elongate shape has its longest extent parallel to the longitudinal direction of the barrel 3. Arranging the grip section in this way makes the grip section easy to handle in the folded-out position. At the same time as the grip does not take up much space in the folded-in position.

In the folded-in position, the second locking shoulder 17 of the grip section lies against the second locking shoulder 18 of the pin 9 under spring tensioning exerted by the helical spring 14. Alternatively, the locking shoulders 17, 18 can be omitted, and the grip section kept in place solely by the spring tensioning of the helical spring. The transition of the curved sliding surface 25 to a surface of the grip section in its longitudinal direction can in this case be shaped to stick out from the grip in order to further mark the folded-in position of the grip. When the grip is folded out, the grip section 7 is pulled rearwards and out from the barrel. The second locking shoulder 17 of the grip section is then released from the second locking shoulder 18 of the pin. During the movement of the grip section from the folded-in position to the folded-out position, the sliding surface 25 of the grip section is in contact with the sliding surface 22 of the plate 11. When the grip section reaches the folded-out position, the grip section is displaced in further over the pin under the action of the spring 14, at the same time as the first locking shoulder 15 of the grip section comes into engagement with the first locking shoulder 16 of the pin. Continued movement is stopped by virtue of the fact that the end surface 21 of the grip section now lies against the sliding surface 22 of the curved plate 11 under spring tensioning. In order to return the grip to the folded-in position, the grip section is pressed forwards and out from the barrel. The first locking shoulders of the grip section and of the pin then let go and the grip section can be returned to the folded-in position with sliding cooperation between the sliding surfaces 25 and 22 and locking in the folded-in position with cooperation of the second locking shoulders of the grip section and of the pin, or solely spring tensioning. Upon renewed use of the weapon, the movement of the grip section is repeated in the same way as described above.

We claim:

1. A foldable grip for mounting on an elongate object, such as the barrel of a portable weapon, said grip comprising an elongate grip section and a hinge for connecting the grip section to the elongate object, said grip in the folded-in position having a longitudinal direction which extends essentially parallel to the longitudinal direction of the object and in the folded-out position having a longitudinal direction which extends essentially at right angles out from the longitudinal direction of the elongate object, wherein the hinge comprises an oblique pin to be affixed on the elongate object and an oblique hole formed in the grip section to cooperate with the pin for effecting an essentially 90 degree turn of the grip section around an axis in the longitudinal direction of the grip section during the movement of the grip between the folded-in position and the folded-out position.

2. A grip according to claim 1, wherein the pin and the hole are provided with locking shoulders for locking the grip in at least one of the folded-in and folded-out position.

3. A grip according to claim 1, wherein a spring element is arranged to act between the pin and the grip section.

4. A grip according to claim 3, wherein the spring element includes a helical spring.

5. A grip according to claim 1, wherein the pin and the grip section comprise sliding surfaces facing each other and cooperating directly.

6. A grip according to claim 1, wherein the grip section is designed with an elongate shape transverse to the longitudinal direction of the grip section, the elongate shape relating to the hinge so that the grip section in the folded-out position has a greater extent parallel to the longitudinal direction of the elongate object on which the grip is mounted than it has transverse to the longitudinal direction of the object.

7. A foldable grip for mounting on an elongate object, such as the barrel of a portable weapon, said grip comprising an elongate grip section and a hinge for connecting the grip section to the elongate object, said grip in the folded-in position having a longitudinal direction which extends essentially parallel to the longitudinal direction of the object and in the folded-out position having a longitudinal direction which extends essentially at right angles out from the longitudinal direction of the elongate object, wherein the hinge comprises an oblique pin to be affixed on the elongate object and an oblique hole formed in the grip section to cooperate with the pin for the purpose of effecting an essentially 90 degree turn of the grip section around an axis in the longitudinal direction of the grip section during the movement of the grip between the folded-in position and the folded-out position, and wherein the pin and the hole are provided with locking shoulders for locking the grip in at least one of the folded-in and folded-out positions.

8. A grip according to claim 7, wherein a spring element is arranged to act between the pin and the grip section.

9. A foldable grip for mounting on an elongate object, such as the barrel of a portable weapon, said grip comprising an elongate grip section and a hinge for connecting the grip section to the elongate object, said grip in the folded-in position having a longitudinal direction which extends essentially parallel to the longitudinal direction of the object and in the folded-out position having a longitudinal direction which extends essentially at right angles out from the longitudinal direction of the elongate object, wherein the hinge comprises an oblique pin to be affixed on the elongate object and an oblique hole formed in the grip section to cooperate with the pin for the purpose of effecting an essentially 90 degree turn of the grip section around an axis in the longitudinal direction of the grip section during the movement of the grip between the folded-in position and the folded-out position, and wherein the pin and the grip section comprise sliding surfaces facing each other and cooperating directly.

10. A grip according to claim 9, wherein the grip section is designed with an elongate shape transverse to the longitudinal direction of the grip section, the elongate shape relating to the hinge so that the grip section in the folded-out position has a greater extent parallel to the longitudinal direction of the elongate object on which the grip is mounted than it has transverse to the longitudinal direction of the object.

* * * * *